US009057584B2

(12) United States Patent
Chung

(10) Patent No.: US 9,057,584 B2
(45) Date of Patent: Jun. 16, 2015

(54) MODULAR UNIVERSAL MACHINEGUN SIGHT WITH BULLET DROP COMPENSATION DEVICE

(71) Applicant: INTERNATIONAL TRADE AND TECHNOLOGIES, INC., McLean, VA (US)

(72) Inventor: Sung Giu Chung, McLean, VA (US)

(73) Assignee: INTERNATIONAL TRADE AND TECHNOLOGIES, INC., McLean, VA (US)

( * ) Notice: Subject to any disclaimer, the term of this patent is extended or adjusted under 35 U.S.C. 154(b) by 0 days.

(21) Appl. No.: 14/251,214

(22) Filed: Apr. 11, 2014

(65) Prior Publication Data

US 2014/0305022 A1 Oct. 16, 2014

Related U.S. Application Data

(60) Provisional application No. 61/811,380, filed on Apr. 12, 2013.

(51) Int. Cl.

| | |
|---|---|
| ***F41G 1/32*** | (2006.01) |
| ***F41G 1/16*** | (2006.01) |
| ***F41G 1/38*** | (2006.01) |
| ***F41G 1/387*** | (2006.01) |

(52) U.S. Cl.

CPC .. *F41G 1/32* (2013.01); *F41G 1/16* (2013.01); *F41G 1/38* (2013.01); *F41G 1/387* (2013.01)

(58) Field of Classification Search

CPC ..... F41G 1/16; F41G 1/17; F41G 1/26; F41G 1/28; F41G 1/30; F41G 1/32; F41G 1/34; F41G 1/345; F41G 1/35; F41G 1/36

USPC ..... 42/113, 115, 122, 125, 131, 135–140

See application file for complete search history.

(56) References Cited

U.S. PATENT DOCUMENTS

| | | | | |
|---|---|---|---|---|
| 3,492,733 | A * | 2/1970 | Leatherwood | 42/122 |
| 4,389,791 | A * | 6/1983 | Ackerman | 42/122 |
| 4,940,324 | A * | 7/1990 | Nichols | 356/247 |
| 5,134,798 | A * | 8/1992 | Lee | 42/148 |
| 5,272,514 | A * | 12/1993 | Dor | 356/251 |
| 5,671,561 | A * | 9/1997 | Johnson et al. | 42/114 |
| 7,243,590 | B2 * | 7/2007 | McClellan et al. | 89/36.06 |
| 7,319,557 | B2 * | 1/2008 | Tai | 359/399 |
| 7,634,866 | B2 * | 12/2009 | Javorsky | 42/111 |
| 7,872,747 | B2 * | 1/2011 | Gerlach | 356/251 |
| 8,087,196 | B2 * | 1/2012 | Jung et al. | 42/113 |
| 8,186,093 | B1 | 5/2012 | Chung | |
| 8,240,075 | B1 * | 8/2012 | Mullin | 42/125 |
| 8,296,991 | B1 | 10/2012 | Chung | |
| 8,407,924 | B2 * | 4/2013 | Lee et al. | 42/115 |
| 8,505,231 | B2 | 8/2013 | Chung | |
| 2009/0193705 | A1 * | 8/2009 | LoRocco | 42/123 |
| 2010/0162611 | A1 * | 7/2010 | Samson et al. | 42/125 |
| 2011/0297744 | A1 * | 12/2011 | Schneider et al. | 235/414 |
| 2012/0030985 | A1 * | 2/2012 | Mauricio et al. | 42/84 |
| 2013/0008072 | A1 | 1/2013 | Chung | |

* cited by examiner

*Primary Examiner* — Stephen M Johnson
*Assistant Examiner* — Benjamin Gomberg
(74) *Attorney, Agent, or Firm* — Birch, Stewart, Kolasch & Birch, LLP

(57) ABSTRACT

A Universal Machinegun Sight (UMS) with a modular design is discussed, whereby the UMS includes a main body receiving a lens body in a detachable manner; a mounting solution disposed in the main body; a wheel type bullet drop compensation device to accept various caliber disks and disposed in the main body; a removable LED module disposed on the main body; and a magnification mounting rail disposed on the main body.

17 Claims, 26 Drawing Sheets

100

300

300

300

MODULAR UNIVERSAL MACHINEGUN SIGHT WITH BULLET DROP COMPENSATION DEVICE

CROSS REFERENCE TO RELATED APPLICATIONS

This application claims the benefit of U.S. provisional application No. 61/811,380 filed on Apr. 12, 2013, which is incorporated by reference.

BACKGROUND OF THE INVENTION

1. Field of the Invention

Embodiments of the invention relate to a modular sight device that is designed and built for firearms, especially medium and heavy machine guns, for the purpose of use with armed forces, hunters, and law enforcement agencies.

2. Discussion of the Related Art

Iron sights are commonly used by shooters for aiming firearms such as rifles, or medium and heavy machine guns. Each iron sight requires the shooter to align a rear and front sights of a rifle along with the target, which requires trainings and shooting skills.

Dot sights were developed for the purpose of offering rapid target acquisition of both stationary and moving targets with minimal training. A sight can easily convert non-experienced shooter into a skilled marksman. A sight is also commonly known as a non-magnifying reflector (or reflex) sight that is mounted on firearms to provide the shooter an aiming indication in the form of a red dot or a red dot with a circle. Sights are designed and developed to offer shooters, such as sportsmen, hunters, policemen and soldiers the ability to acquire and engage target or targets quickly and effectively. Sights are user friendly devices in the sense that it only requires the shooter to aim the red dot on the target and upon pulling the trigger, a projectile will impact the point of aim.

A dot sight comes with a red light-emitting diode (LED) at the focus of the collimating optics to generate a light that is visible to the human eye. A visible dot remains parallel to a bore of the firearm no matter what position the human eye is in relative to the dot sight.

A very large field of view design enables the shooter to keep both eyes open during operation to enable an unlimited field of view at any distance. The eye relief is also unlimited, which means that the shooter's eye position behind the sight does not affect how well the shooter sees the target.

Shooting with both eyes open offers the shooter enhanced situational awareness to allow the possibility to deal with multiple targets. A dot sight helps a shooter to become an effective marksman offering ability to aim accurately and quickly under any extreme or stressful conditions.

A parallax free dot sight refers to a visible dot that remains parallel to a bore of the firearm, so no matter what position the shooter's eye is in, it will remain relative to the sight allowing the shooter to engage a target or targets in stationary or moving platforms (i.e. helicopters and boats.)

SUMMARY OF THE INVENTION

The disclosures of U.S. Pat. Nos. 8,186,093, 8,296,991, 8,505,231, and US Publication No. 2013-0008072 A1 are incorporated by reference.

Currently, the US military is facing a variety of challenges, including budget cuts, sequestration, shot-down and other financial crisis that limits their ability to purchase latest weapon systems. Therefore, Program Managers are looking for modular design equipment so that equipment purchased can be quickly upgraded to meet any future operational needs. In addition, they are looking for equipment that requires less maintenance or easy/convenient maintenance. The UMS is designed to meet the current US military requirements in terms of low maintenance, and ease of any future upgrade. The UMS is designed to save money as soldiers only need one sight for all their machineguns just by replacing the disk or the LED module to match their specific gun. In addition, soldiers have an option to select different size lens to match their operational requirements.

A sight device offers a very large field of view design that provides rapid target acquisition for both stationary and moving targets. In addition, the sight device also provides pin-point accuracy, which ensures that every bullet is on target to ultimately suppress enemies faster, reduce collateral damage, and conserve ammunition. Such sight devices are available for various medium and heavy machineguns.

However, different sight devices are needed for different types of machineguns such as small, medium and large sight devices. To provide one universal sight device for all machineguns, the Universal Machinegun Sight (UMS) was developed.

The UMS includes lens body, protective lens cover, 3-5× Magnification mount and main body. The main body comes with the removable LED module with two visible (red and Green) lights, the wheel type bullet drop compensation device, where disks can be changed to accommodate different caliber machineguns. Commonly available disks are 5.56 mm, 7.62 mm, 12.7 mm, and dual caliber disks (7.62/12.7) but other type of disks could be designed to allow operation of the UMS with various machineguns. Due to its modular design, the lens body is able to be detached from the main body and allow users to install other size lens to meet their operational requirements.

The wheel type bullet drop compensation device with up to 16 range settings ensures that every bullet is on target to ultimately suppress enemies faster and for those soldiers wishing for a lighter and simpler design UMS, we offer the UMS with a MIL DOT CIRCLE reticle. The MIL DOT CIRCLE reticle offers an operation of the UMS without the wheel type bullet drop compensation device. Typically, a MIL DOT CIRCLE reticle comes with multiple hash marks to allow users to estimate the distance (rangefinder) to a target and neutralize enemies with a pin-point accuracy.

One of the greatest advantages of this modular design is that the lens body can be assembled very simply using the outer lens retention frame and the inner lens retention frame. The lens used by the UMS is secured to the lens body using these retention frames. In addition, we can identify the best focal point for a reticle by moving the lens body backward and by adjusting the thickness of inner and outer lens retention frames. The UMS with a removable LED module and a lens body reduces manufacture costs by creating less waste of raw materials and a simply manufacturing process. For users, the UMS offers a low maintenance cost as any defective module can be quickly replaced eliminating the need to buy a new sight. Also, the modular design of UMS, offers affordable/convenient upgrade options.

An object of an embodiment of the invention is to provide one dot sight device called the Universal Machinegun Sight (UMS) for various firearms, such as machineguns. The UMS comes with a wheel type bullet drop compensation device capable of accepting various disks (5.56 mm, 7.62 mm. 12.7 mm, dual disk and others) that are used to target an object at a distance. Soldiers can quickly select and install the right disk to match their machineguns. Also, the UMS may be used without a bullet drop compensation device using a MIL DOT CIRCLE reticle.

Another object of an embodiment of the invention is to provide the UMS that can be easily and quickly upgraded. Typically, the UMS will be offered with a medium size lens but a user can quickly upgrade it with a small or large size lens to match their specific mission scenario and it takes only seconds to replace it.

Another object of an embodiment of the invention is to provide a UMS that offers a low profile design to better protect shooters and also offer very comfortable/natural shooting position. Generally, the UMS with a MIL DOT CIRCLE reticle is much lighter and smaller.

Another object of an embodiment of the invention is to reduce cost of manufacturing a dot sight device. The modular design UMS reduces raw materials needed to manufacture by separating the lens body from the main body. In addition, its modular design offers the most cost-effective manufacturing process where the lens body can be quickly attached to the main body. For users, the modular design offers a very low maintenance and easy to upgrade options as modules can be upgraded with the latest technologies. For instance, if the lens is broken or scratched, the modular design offers an option to just replace the lens body.

Another object of an embodiment of the invention is to provide shooters options to install the 3-5× magnification mount to convert a machinegun into a sniper weapon. The 3-5× magnification mount can be quickly attached to the UMS without using any tools. In addition, the 3-5× magnification mount is designed to accommodate night vision, bullet or EyePiece cameras and other optical devices. By installing a camera on the 3-5× magnification mount, soldiers can easily convert a machinegun into a corner-shot-gun. For this configuration, users need a display to see targets. Typical display are LCD monitor, Head Mounted Display (HMD), hand held PDA and others.

The UMS comes with 3 picatinny rails on the lens body allowing users to install illuminators, laser pointers and a thermal camera to convert the UMS truly to a day and night sight.

Another object of an embodiment of the invention is to provide users an option to select the right color LED. The UMS comes with red and green visible lights where an operator can select the right color for a reticle. Usually, green light is more effective during day light operations.

Another object of an embodiment of the invention is to offer very aerodynamic design sight where foreign debris such as snow, dirt, sand and other foreign objects are prevented from accumulating in front of the removable LED module obstructing projection of red dot on the lens.

Another object of an embodiment of the invention is to offer a removable LED module so that users can quickly replace it with another LED module with different reticles design/shapes such as the circle dot, 5.56 mm MIL DOT CIRCLE reticle, 7.62 MIL DOT CIRCLE reticles, 12.7 mm MIL DOT CIRCLE reticle and others.

Additional features and advantages of this invention will be set forth in the description which follows, and in part will be apparent from the description, or may be learned by practice of this invention. The objectives and other advantages of this invention will be realized and attained by the structure partially pointed out in the written description and claims thereof as well as the appended drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Figure 1A:
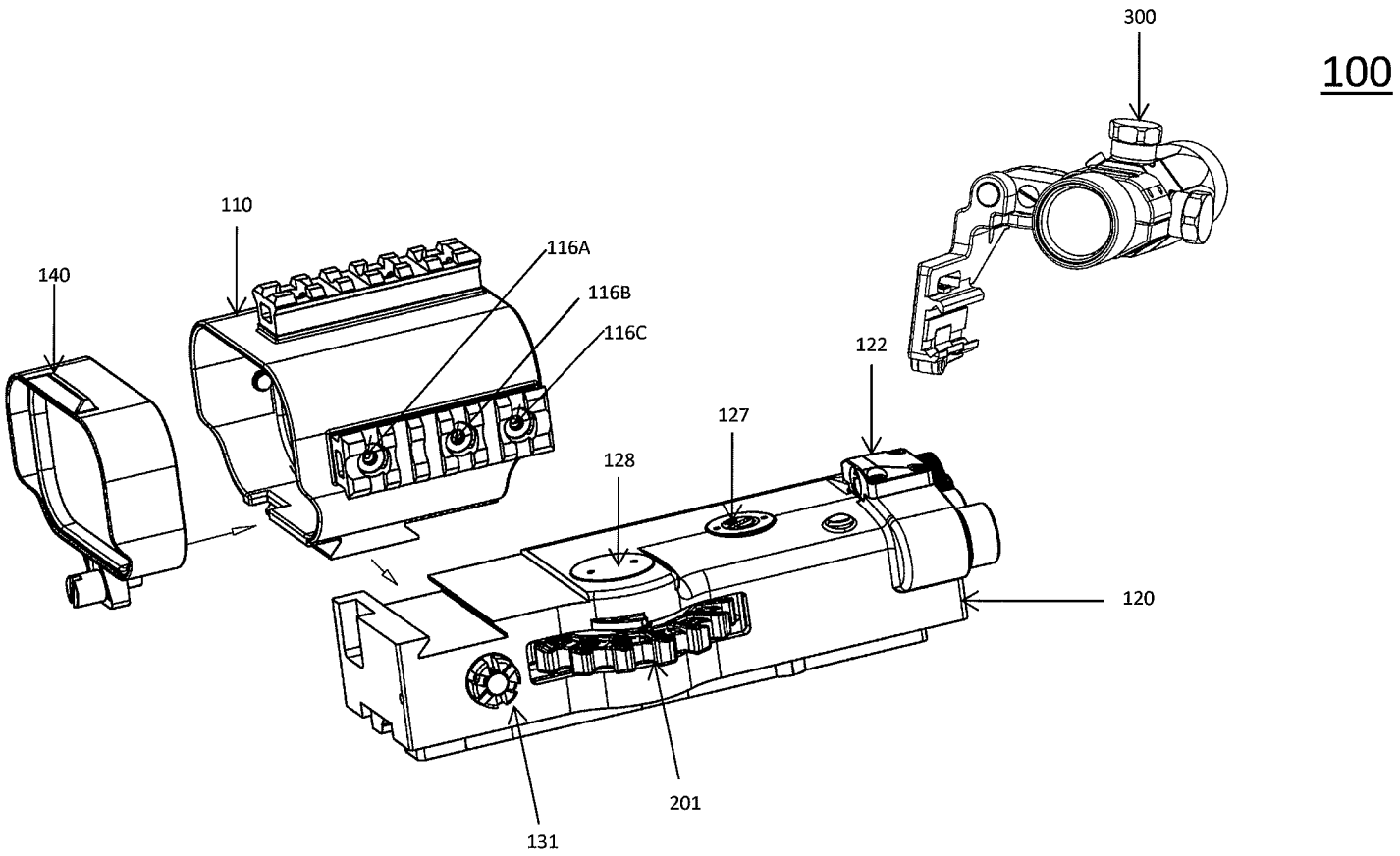
FIG. 1A shows all the main components of the modular design Universal Machinegun Sight (UMS) according to an example embodiment of the invention.

Hereinafter, example embodiments of this invention will be described in detail with reference to FIGS. 1A-4B. Like reference numerals designate like elements throughout the specification.

FIG. 1A shows the modular design Universal Machinegun Sight (UMS) 100 according to an example embodiment of the invention. The UMS 100 according to an example embodiment of the invention includes a lens body 110, a main body 120, a 3-5× magnification mount 300 and a protective lens cover 140.

Figure 1B:
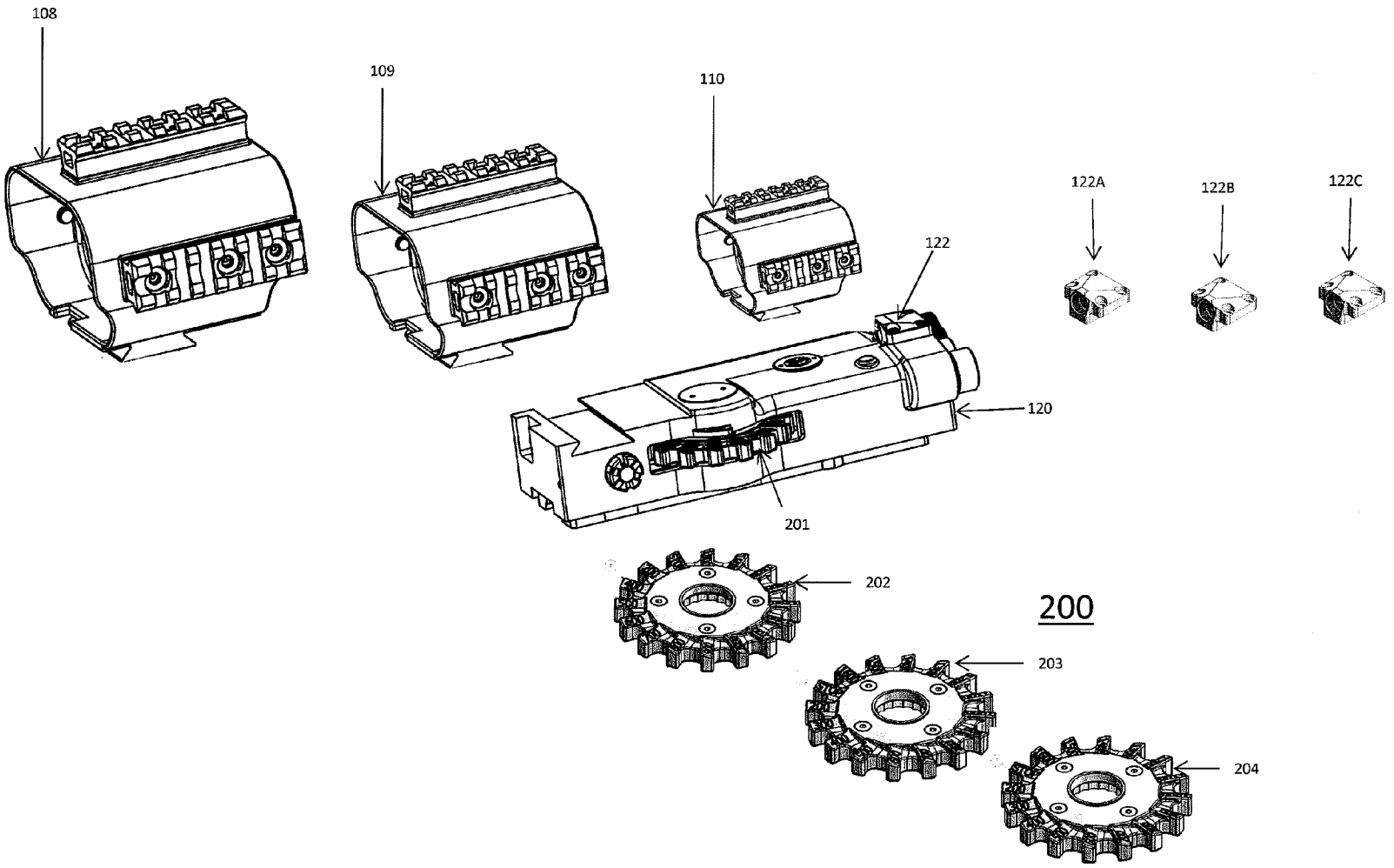
FIG. 1B shows all the Universal Machinegun Sight (UMS) with 3 different lens bodies (small, medium and large), 3 different removable LED modules (5.56 MIL DOT CIRCLE reticle, 7.62 MIL DOT CIRCLE reticle and 12.7 MIL DOT CIRCLE reticle), one wheel type bullet drop compensation devise with the 5.56 mm disk pre-installed and 3 extra disks representing other calibers, according to an example embodiment of the invention.

FIG. 1B shows the main body with various lens bodies, various removable LED modules, and various bullet drop compensation disks. The main body 120 is designed to accommodate a large lens body 108, a medium lens body 109 or a small lens body 110. The main body 120 supports a wheel type bullet drop compensation device 200 with one pre-installed 5.56 mm disk 201, and the LED module 122. The wheel type bullet drop compensation device 200 is designed to accommodate other disks such as a 7.62 mm disk 202, a 12.7 mm disk 203, and a dual disk (7.62 mm/12.7 mm) 204. Typically, a disk can have at least 16 settings (shown as extensions on each disk in FIG. 1B). So, a dual disk 204 could be manufactured with 8 settings per caliber such as 7.62 mm (8 settings) and 12.7 mm (8 settings). The main body 120 also accommodates the removable LED module 122 and users can quickly install the removable LED module 122 with the 5.56 MIL DOT CIRCLE reticle 122A or 7.62 MIL DOT CIRCLE reticle 122B or 12.7 MIL DOT CIRCLE reticle 122C. In other embodiments of the invention, one or more of the disks 201-204 may have at least one of the settings be a stop setting so that the disk 201-204 will not make a complete 360 degree rotation.

The lens body 108-110 is modular from the main body 120 so that one lens body may be switched out for another lens body. To remove a lens body 108-110, one simply needs to slide out the lens body 108-110 from the main body 120. As shown in FIG. 1B, an extension is formed on a bottom portion of the lens body 108-110 that is coupled to a notch formed at an upper portion of the main body 120. The lens body 108-110 is further secured to the main body 120 by the protective lens cover 140, whereby when the lens cover 140 is attached to the lens body 108-110, a lens locking knob 141 attached to the lens cover 140 may secure the lens body 108-110 to the main body 120 (see FIGS. 1A and 2B).

As shown in FIG. 1B, each disk 201-204 has a plurality of radially extending extensions, an intermediate ring portion, and an aperture in the middle of the intermediate ring portion. The aperture has a smooth upper wall portion and a toothed lower wall portion.

Figure 1C:
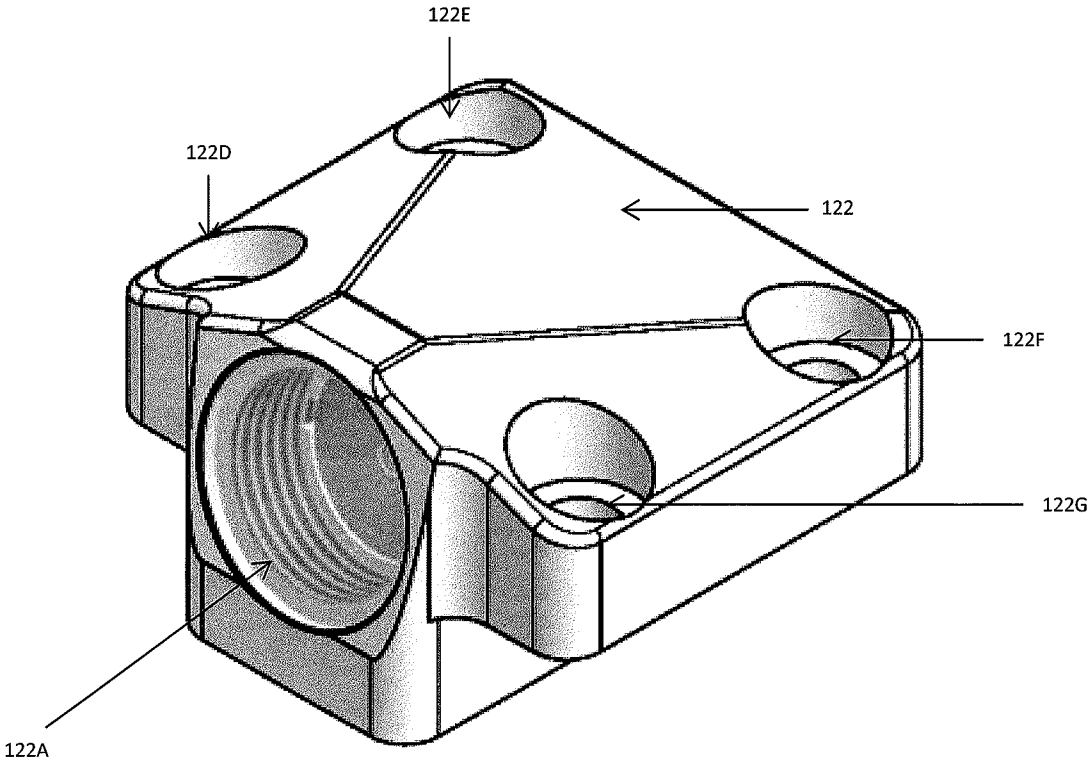
FIG. 1C shows a perspective view of the Removable LED module according to an example embodiment of the invention.

FIG. 1C shows the perspective view of the removable LED module 122 with 4 screw holes on the top (122D, 122E, 122F and 122G) to allow an easy installation of the module to the main body 120. The number of the screw holes may be other than 4. Additionally, the removable LED module 122 has an aperture 122A in the front thereof. The aperture 122A may be circular, but other shapes may be used, including an oval shape, or a rectangular shape, for example.

Figure 1D:
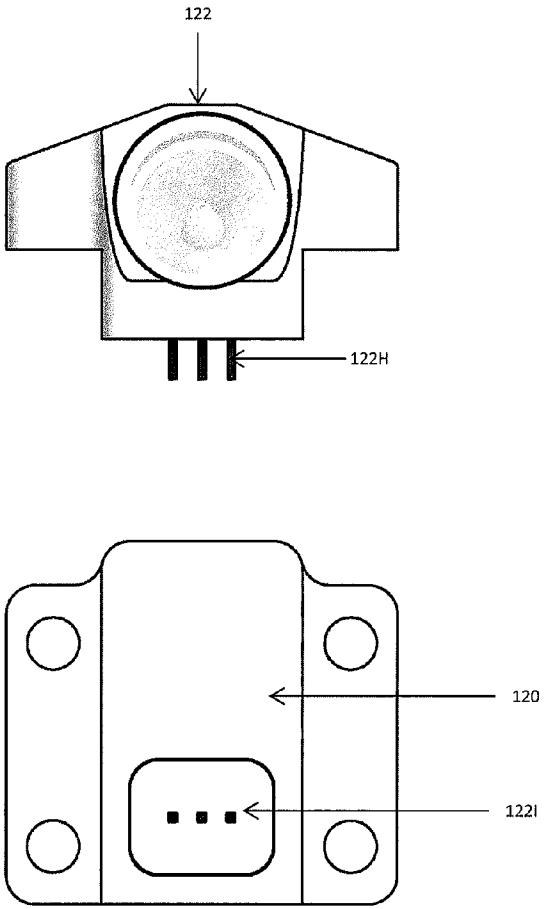
FIG. 1D shows a front plan view of the Removable LED module and a section of the main body showing in detail the area where the Removable LED module is installed or plugged in according to an example embodiment of the invention.

FIG. 1D shows the front plan view of the removable LED module 122 with a section of a main body 120 where the removable LED module 122 is plugged in or installed to the main body 120. The LED light is connected to the main body 120 by plugging the 3 male cables 122H to the 3 female cables receivers 1221. This simple plug in design offers an easy installation of the removable LED module 122 to the main body 120. Other plug types may be used.

Figure 1E:
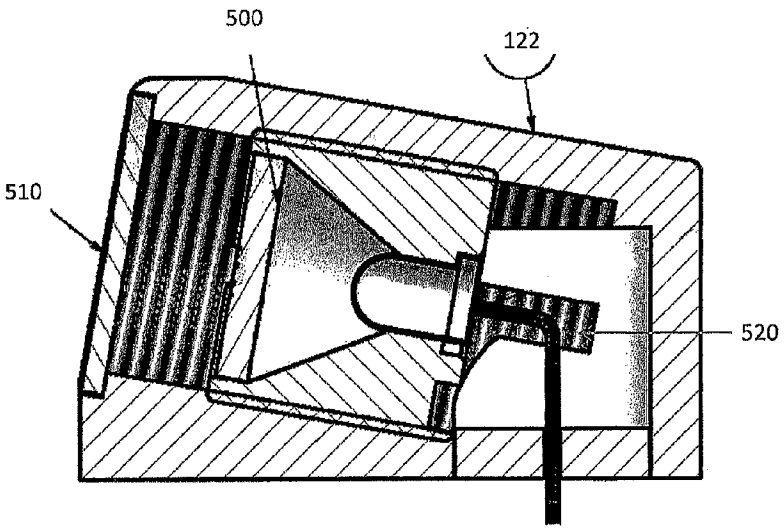
FIG. 1E shows an inside view of the removable LED module with various design/shape etched lenses according to an example embodiment of the invention.
Figure 1E:
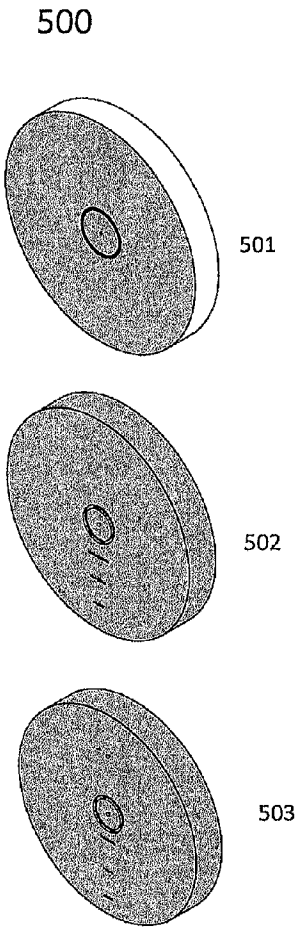

FIG. 1E shows the inside view of the removable LED module 122 with various etched lenses 500 (e.g., 501, 502 and 503). These etched lenses 500 are a part of the removable LED module 122 and it projects an illuminated reticle to the lens body 110. The circle dot reticle 501 will be mainly used with the UMS 100 with the wheel type bullet drop compensation device 200.

Figure 1F:
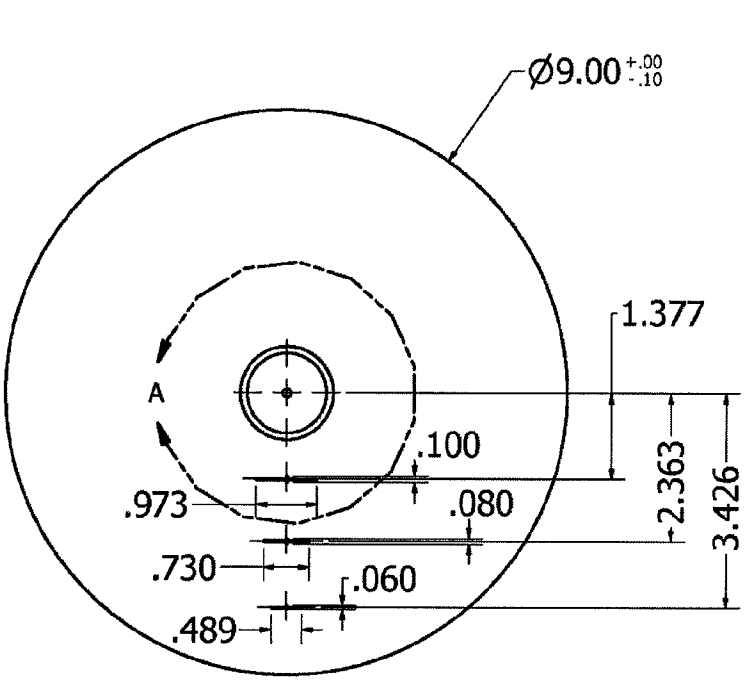
FIG. 1F shows a perspective view of a 7.62 etched lens according to an example embodiment of the invention.
Figure 1F:
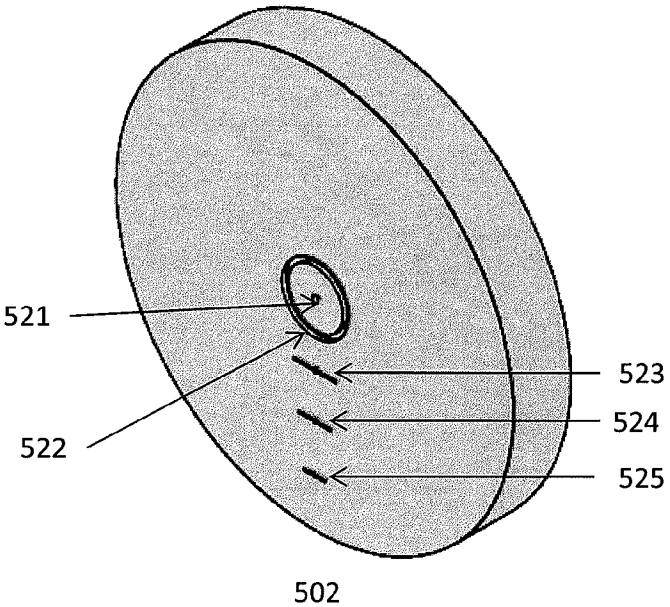

FIG. 1F shows the perspective view of the 7.62 etched lens 502 with a dot, circle, and 3 hash marks where the width of hash mark represents a length of 5 m truck at that range. So, a user can use the 7.62 MIL DOT CIRCLE reticle as a rangefinder. For shooting at a 100 m range, a shooter must point a dot 521, which may be the red or green dot to a target. Furthermore, the top hash mark 523 represents a 750 m range, the middle hash mark 524 represents a 1000 m range and the bottom hash mark 525 represents a 1200 m range to a target. Also, the top edge of the bottom circle 522 represents a 500 m range.

Figure 1G:
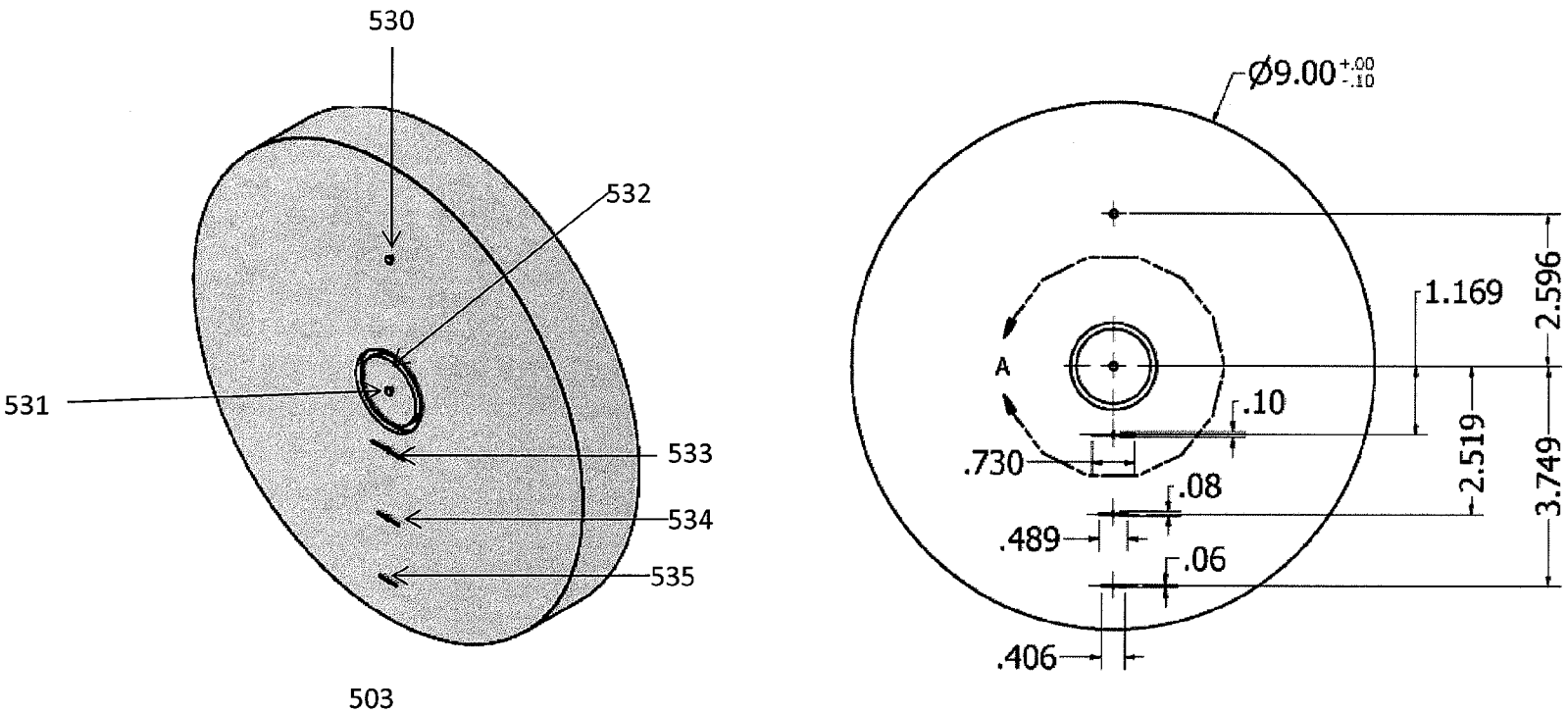
FIG. 1G shows a perspective view of a 12.7 etched lens according to an example embodiment of the invention.

FIG. 1G shows the perspective view of the 12.7 etched lens 503 with a dot, dot/circle, and 3 hash marks where the width of hash mark represents a length of 5 m truck at that range. So, a user can use the 12.7 MIL DOT CIRCLE reticle as a range finder. For shooting a target at a 100 m range, a shooter has to point the top red or green dot to a target. For shooting a target at a 500 m range, a shooter has to point the dot 531 in the middle of a circle 532 to a target. A shooter knows that the target is at a 500 m range when a 5 m truck can be filled inside the circle 532. The top hash mark 533 represents a 1000 m range, the middle hash mark 534 represents a 1500 m range and the bottom hash mark 535 represents a 2000 m range to a target.

Figure 1H:
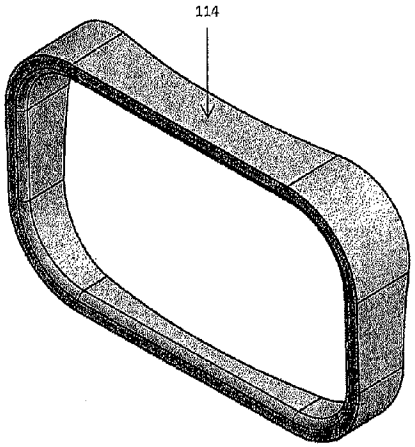
FIG. 1H shows a perspective view of an outer lens retention frame according to an example embodiment of the invention.

FIG. 1H shows the outer lens retention frame 114 which is designed to secure the sight lens 143 inside the Lens body 110. Just by adjusting the thickness of the outer lens retention frame 114, the best focal angle can be identified. The outer lens retention frame 114 is a rectangular configuration.

Figure 1I:
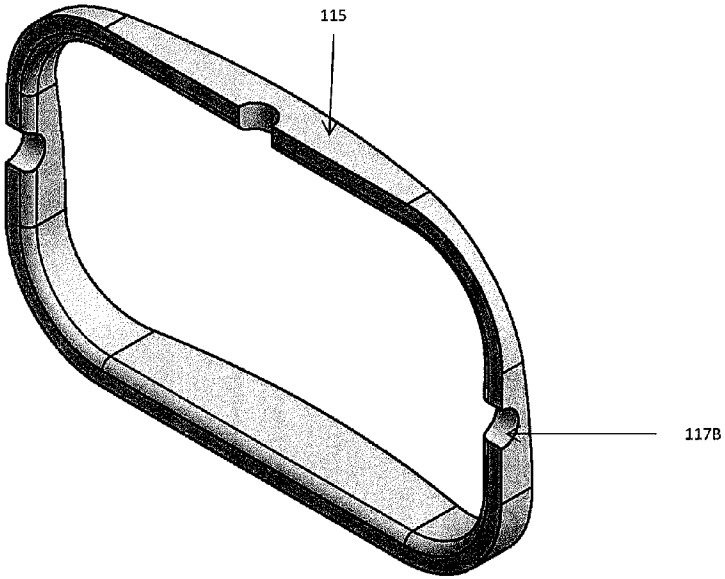
FIG. 1I shows a perspective view of an inner lens retention frame according to an example embodiment of the invention.

FIG. 1I shows the Inner lens retention frame 115 which is designed to secure the sight lens 143 inside the Lens body 110. The inner lens retention frame 115 prevents the sight lens 143 from becoming loose and also protects the sight lens 143 from breaking. The inner lens retention frame 115 includes a plurality of rounded notches.

In embodiments of the invention, the outer lens retention frame 114 and the inner lens retention frame 115 cooperate to retain the sight lens 143 inside the lens body 110. Particularly, the outer lens retention frame 114 supports the sight lens 143 from one side and the inner lens retention frame 115 supports the sight lens 143 from the other side, so that the sight lens 143 is wedged between the outer lens retention frame 114 and the inner lens retention frame 115. An incline angle of the sight lens 143 relative a vertical direction of the lens body 110 may be controlled by the outer lens retention frame 114 and the inner lens retention frame 115. An inclined angle of the sight lens 143, in conjunction with a distance between the sight lens 143 and the removable LED module 122, is used to focus the red or green light from the removable LED module 122 for accurate targeting. That is, by varying the inclined angle of the sight lens 143, and the distance between the sight lens 143 and the removable LED module 122, the red or green light from the removable LED module 122 is focused on a surface of the sight lens 143. In embodiments of the invention, the inclined angle and the distance may be pre-set prior to use of the UMS.

When the sight lens 143 is wedged between the outer lens retention frame 114 and the inner lens retention frame 115, rail bolts 116A, 116B, 117A and 117B may secure the outer lens retention frame 114 and the inner lens retention frame 115. For example, the rail bolt 116A and 116B may secure the left side of the lens retention frame 114, 115 to the lens body 110, and the rail bolt 117A and 117B may secure the right side of the lens retention frame 114, 115 to the lens body 110 (see FIGS. 1A and 2B). Another rail bolt 117C may be present for additional securement of a picatinny rail.

Figure 2A:
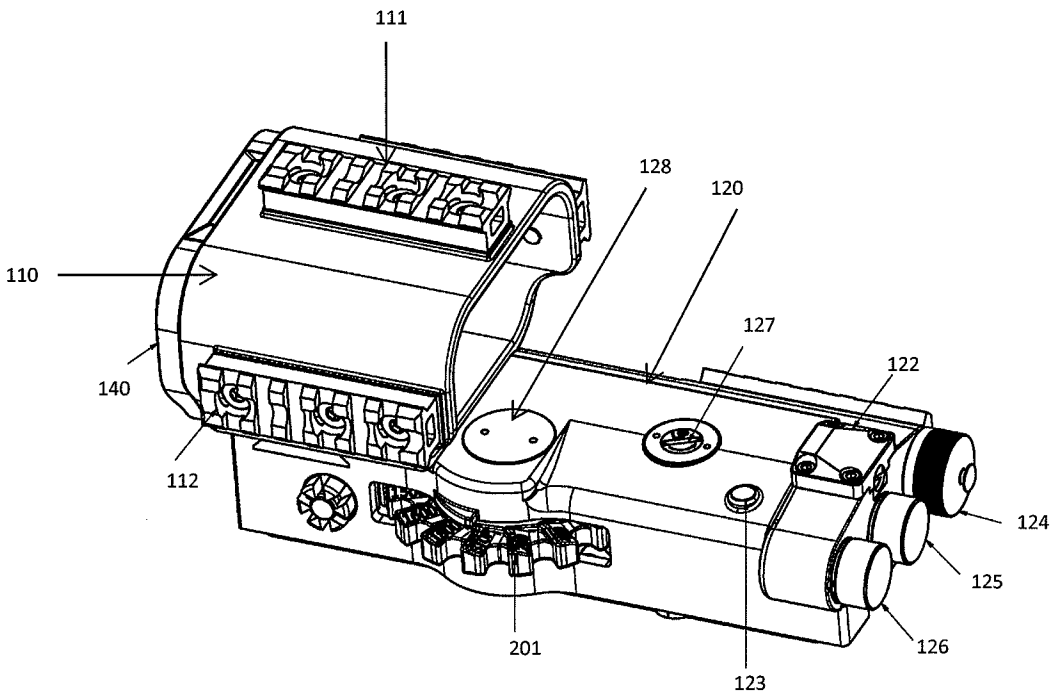
FIG. 2A shows a perspective view of a left side of a Universal Machinegun Sight (UMS) according to an example embodiment of the invention.

The FIG. 2A shows the Universal Machinegun Sight (UMS) 100 with the lens body 110 with the protective lens cover 140 installed. The main body 120 supports a battery case 124, an auto or manual brightness switch 126, an automatic brightness detector 123, an on/off switch 125 to turn on/off red or green light, an elevation control knob 127 and a cover 128 for replacing various disks 200.

Figure 2B:
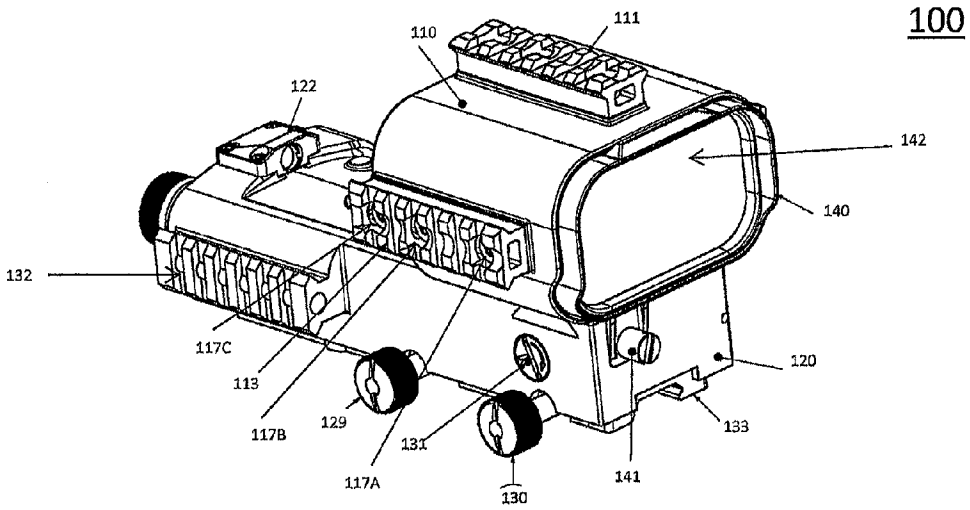
FIG. 2B shows a perspective view of a right side of the UMS according to an example embodiment of the invention.

As shown in FIG. 2B and in greater detail, the lens body 110 with the protective lens cover 140 is attached to the main body 120 by using a lens locking knob 141. The main body 120 supports a windage control knob 131 which is located in a front/right side of the main body 120, a first sight locking bolt 129, a second sight locking bolt 130 used in attaching the UMS 100 to various machineguns and a dedicated magnification mounting rail 132. The bolts 129 and 130 eliminate the need for wrenches that can be misplaced or lost during a deployment.

Figure 2C:
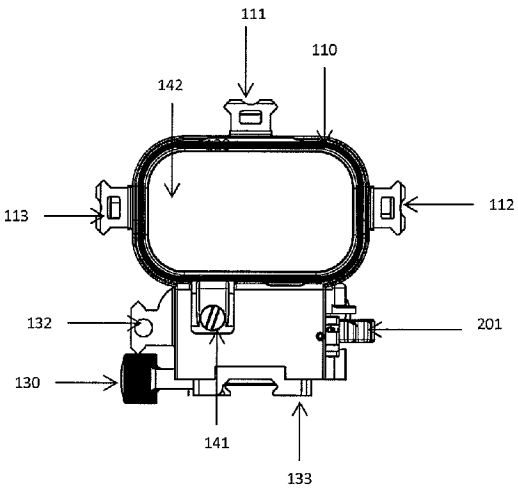
FIG. 2C shows a frontal view of the UMS according to an example embodiment of the invention.

FIG. 2C shows a front plan view of the UMS 100 with the protective lens cover 140 installed which is secured to the main body 120 by the lens locking knob 141. The protective lens 142 is a transparent lens but it could be a polarized filter or a honeycomb structure. The lens body 110 is shown with a top rail 111, a right rail 113 and a left rail 112 which can be used to install illuminators, aiming lasers, laser range finders, flash lights and other accessories.

Figure 2D:
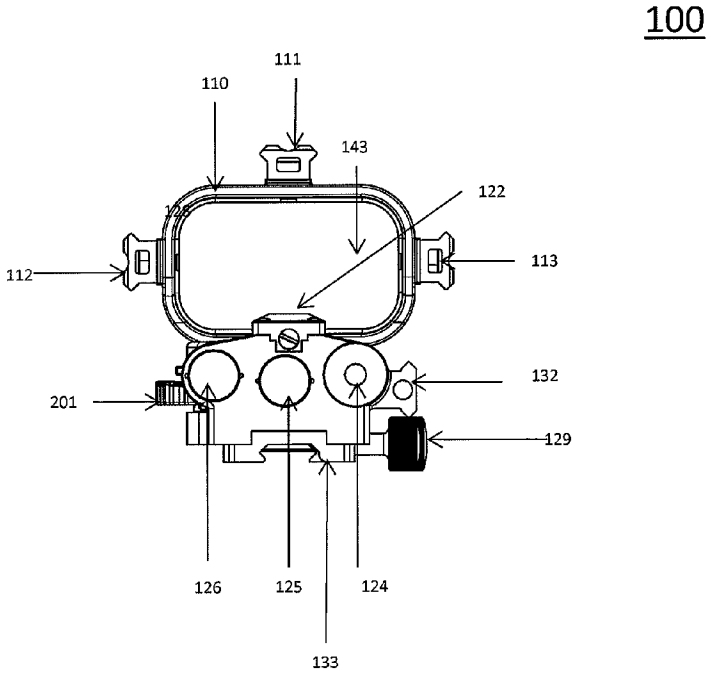
FIG. 2D shows a back view of the UMS according to an example embodiment of the invention.

FIG. 2D shows a back plan view of the UMS 100 with the removable LED module 122, the mounting solution 133 beneath the main body 120 and the first sight locking bolt 129. The LED module 122 projects red or green light on the sight lens 143 using the on/off switch 125 and a brightness of the light can be controlled using the auto or manual brightness switch 126. The mounting solution 133 is directly attached to a machinegun's picatinny rail and the mounting solution 133 is secured or locked using the first 129 and second 130 sight locking bolts.

Figure 2E:
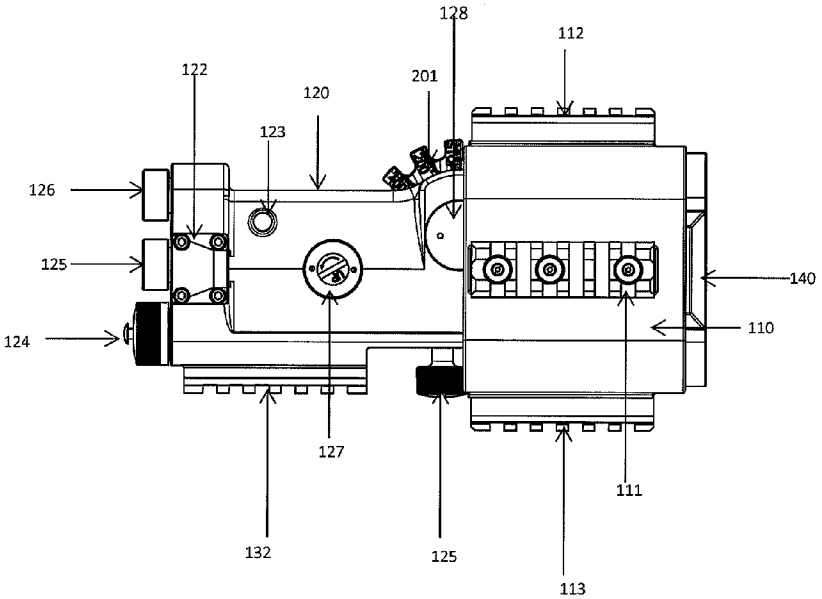
FIG. 2E shows a top plan view of the UMS according to an example embodiment of the invention.

FIG. 2E shows a top plan view of the UMS 100 with the automatic brightness detector 123, the elevation knob 127, the cover 128 and the lens body 110 locked or positioned in the middle of the removable LED module 122 allowing a dot/circle to project in the center (or in an intermediate position) of the sight lens 143. The cover 128 will be used to identify the disk type installed with the UMS 100. It will be clearly marked as 5.56 mm or 7.72 mm or 12.7 mm or 20 mm to match the installed disk type.

Figure 2F:
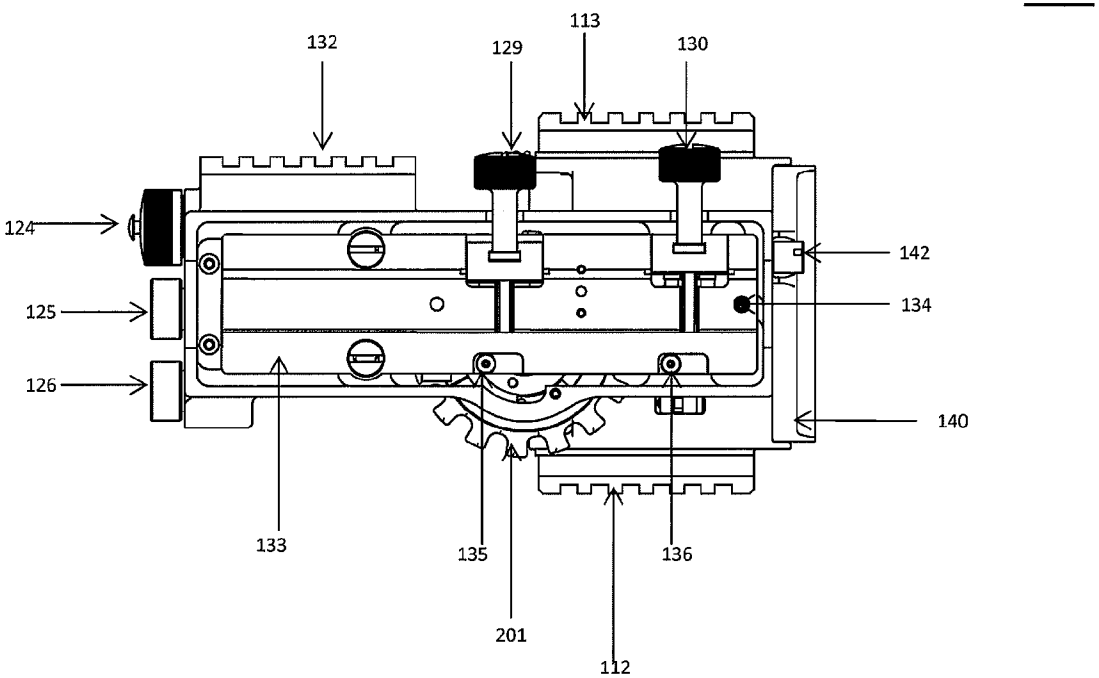
FIG. 2F shows a bottom plan view of the UMS according to an example embodiment of the invention.

FIG. 2F shows a bottom plan view of the UMS 100 with the lens body locking screw 134 that provides an additional locking of the lens body 110 to the main body 120 to withstand shocks and vibrations from machineguns. The mounting solution 133 is designed to allow easy and quick installation to any picatinny rails and the UMS 100 is locked to a machinegun using the first sight locking bolt 129 and the second sight locking bolt 130 without tools. Locking bolts 135 and 136 are used to secure the first sight locking bolt 129 and the second sight locking bolt 130 respectively.

Figure 2G:
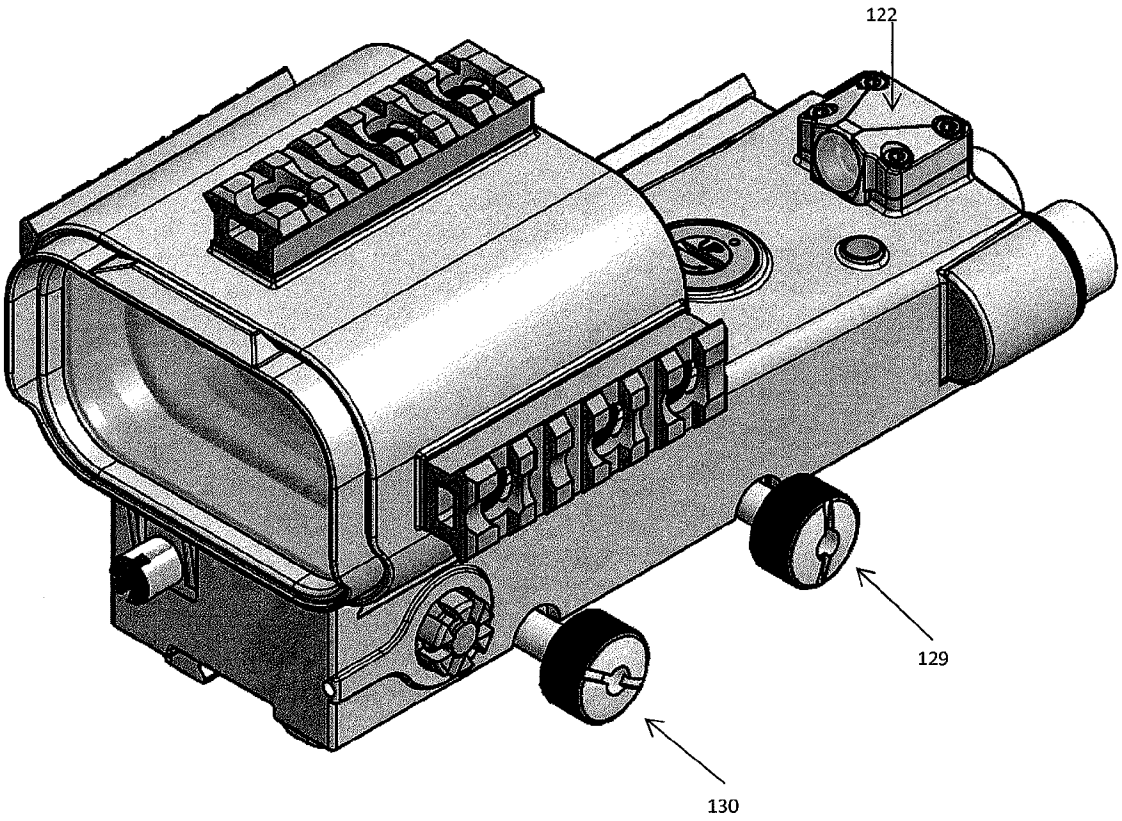
FIG. 2G shows a perspective view of a left side of the UMS without the wheel type bullet drop compensation device according to an example embodiment of the invention.

FIG. 2G shows the UMS 100 without the wheel type bullet drop compensation device 200. The LED module 122 projects a MIL DOT CIRCLE reticle consisting of a dot/circle and hash marks where the width of hash mark represents a length of 5 m truck at that range. As previously shown in FIGS. 1E-1F, the removable LED module 122 with various etched lenses 500 (e.g., 501, 502 and 503) is used in this instance. Basically, a dot/circle and width of hash marks act as a range finder providing a perfect replacement for the wheel type bullet drop compensation device 200 making this UMS smaller and lighter. The first sight locking bolt 129, and the second sight locking bolt 130 used in attaching the UMS 100 to various machineguns are located on the left side, for example, but the placement first sight locking bolt 129 and the second sight locking bolt 130 may be on the right side, or other sides, in other embodiments of the invention. Additionally, in other embodiments of the invention, the wheel type bullet drop compensation device 200 may be used together with the removable LED module 122 with various etched lenses 500 to provide a redundancy or to provide more intermediate ranges.

Figure 3A:
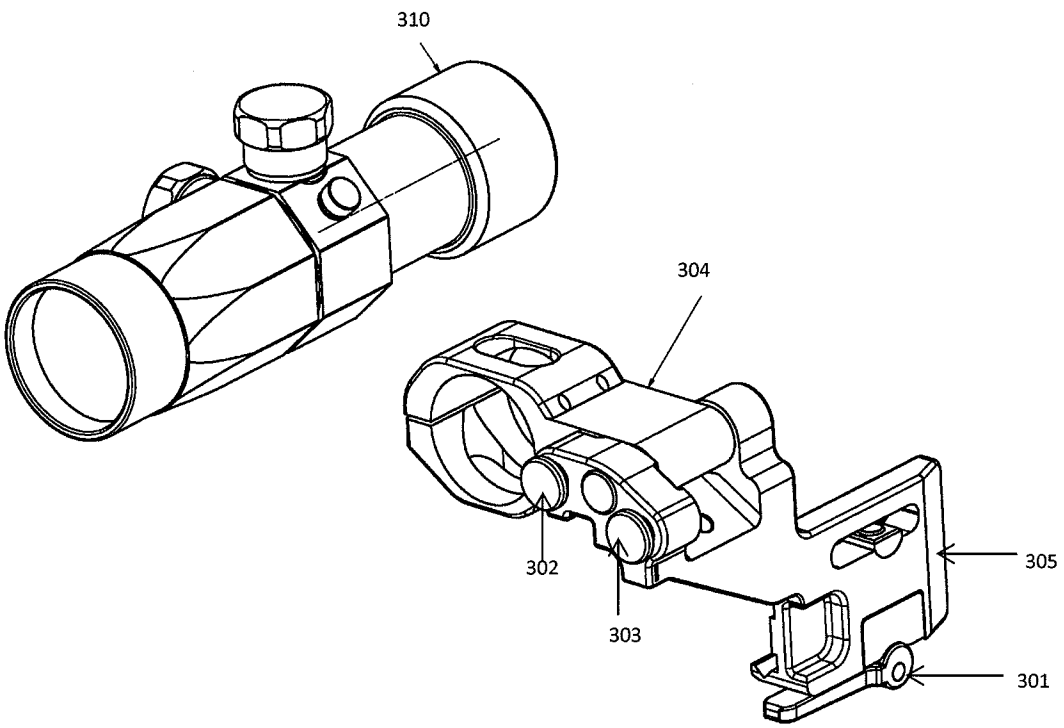
FIG. 3A shows a perspective view of a right side of the 3-5× magnification mount with a 3× Magnifier according to an example embodiment of the invention.

As shown in FIG. 3A and in greater detail, the 3-5× magnification mount 300 is a flip-type mount having a one touch lock 301, a first push button 302, a second push button 303, an optical housing 304 and a base mount 305. The first push button 302 is used to lock or unlock magnifiers or cameras into a deployed position. The second push button 303 is used to lock or unlock magnifiers or cameras into a retracted position. The optical housing 304 is designed to accommodate any magnifiers or cameras. The 3-5× magnification mount 300 can be attached to the UMS 100 using the one touch lock 301. When no magnification is needed, the 3-5× magnification mount can be quickly detached from the main body 120 using the one touch lock 301.

Figure 3B:
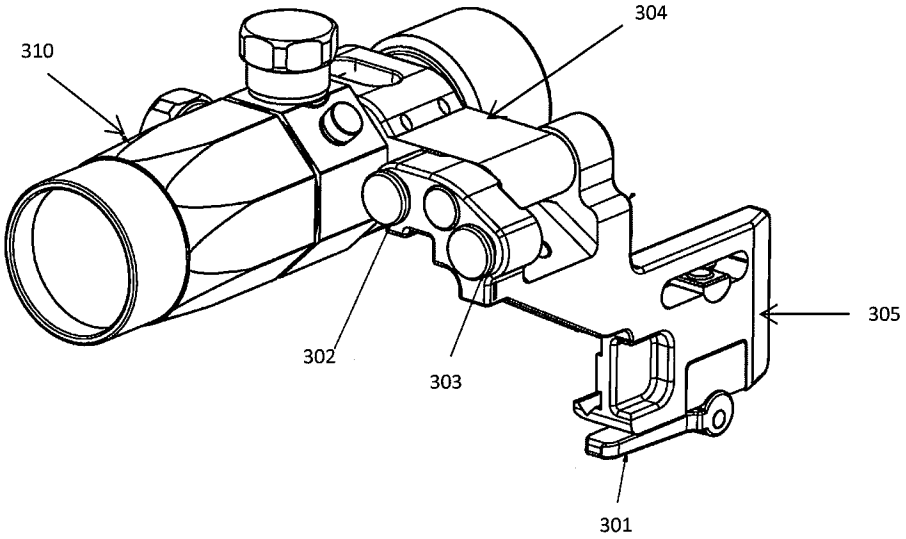
FIG. 3B shows a perspective view of a right side of the 3× magnification mount with a 3× Magnifier installed according to an example embodiment of the invention.

As shown in FIG. 3B and in greater detail, the 3-5× magnification mount 300 with a 3× magnifier 310 is installed to the optical housing 304. The optical housing 304 allows replacement of a 3× magnifier 310 with other optical devices.

Figure 3C:
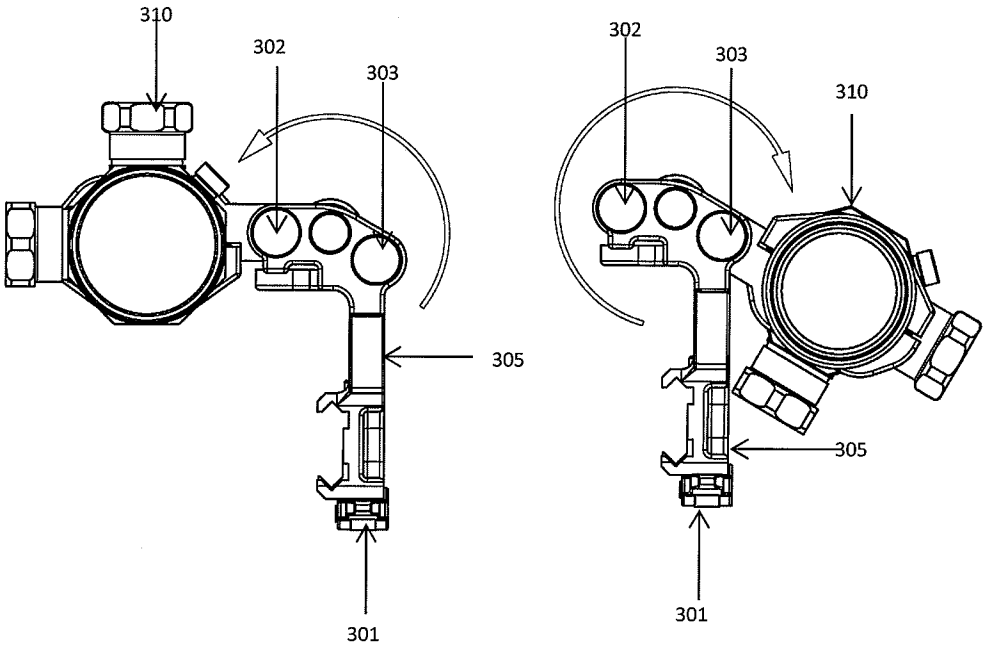
FIG. 3C shows a perspective view of a back side of the 3× magnification mount showing a deployed position (turn counter clockwise) and a retracted position (turn clockwise) according to an example embodiment of the invention.

FIG. 3C shows a back plan view of the 3-5× magnification mount 300 showing a deployed position and a retracted position. To deploy a magnifier, a magnifier is flipped counterclockwise by pushing the second push button 303. To retract a magnifier, a magnifier is flipped clockwise by pushing the first push button 302.

Figure 3D:
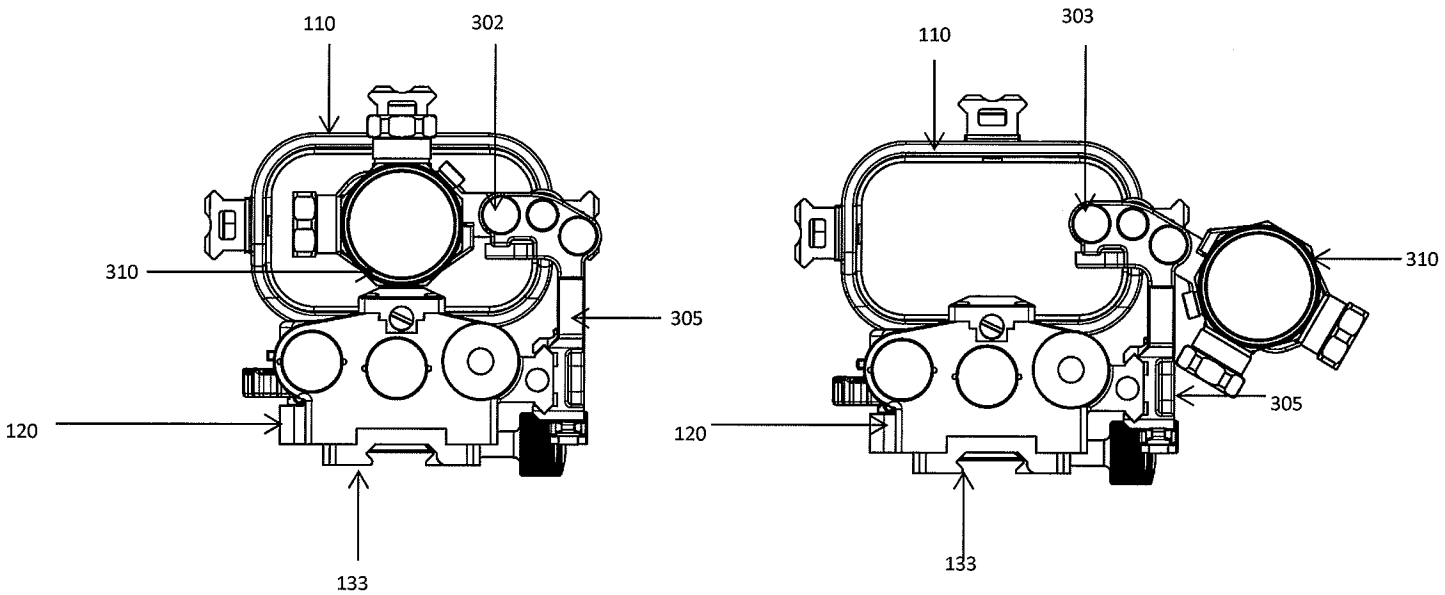
FIG. 3D shows a perspective view of a back side of UMS with the 3× magnification mount in deployed and retracted positions according to an example embodiment of the invention.

FIG. 3D shows a back plan view of the 3-5× magnification mount 300 installed to the UMS 100. When a 3× magnifier 310 is deployed, a magnifier will be securely locked at the center of the sight and lens body 110 allowing users to see the dot/circle in the center. The mount 300 can be easily and quickly removed from the main body 120 simply by using the one touch lock 301.

Figure 3E:
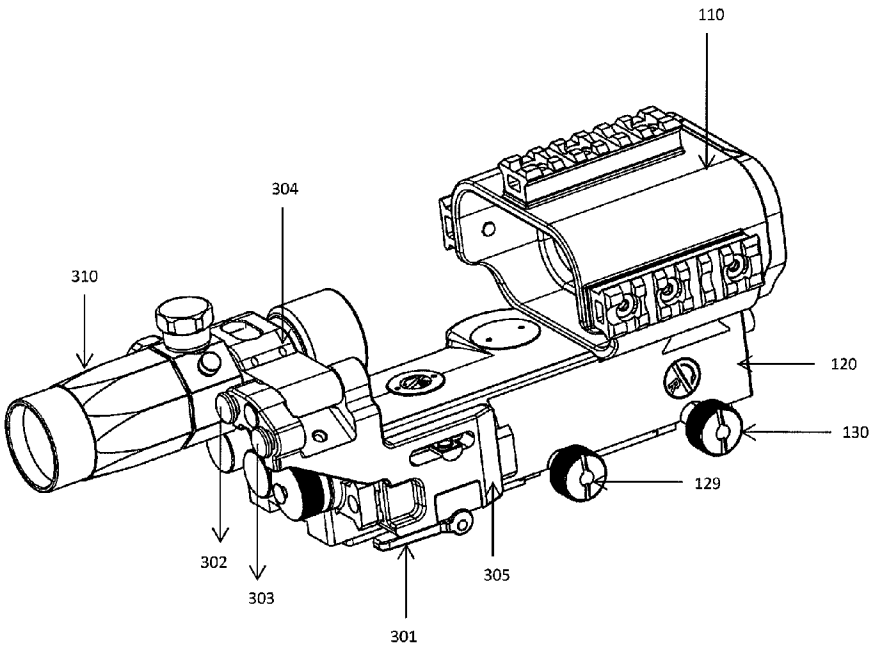
FIG. 3E shows a perspective view of a right side of the UMS with the 3× magnification mount installed on a deployed position (in the middle of sight) according to an example embodiment of the invention.

FIG. 3E shows in greater detail, the 3-5× magnification mount 300 installed to the UMS 100. The 3× magnifier 310 is in the deployed position securely locked by the first push button 302.

Figure 3F:
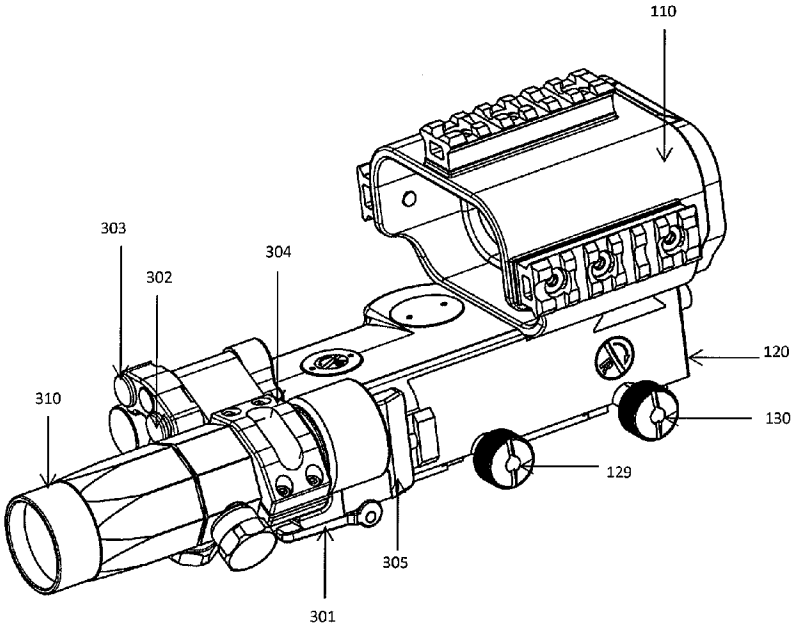
FIG. 3F shows a perspective view of a right side of the UMS with the 3× magnification mount installed on a retracted position (right side) according to an example embodiment of the invention.

FIG. 3F shows in greater detail, the 3-5× magnification mount 300 installed to the UMS 100. The 3× magnifier 310 is in the retracted position securely locked by the second push button 303.

Figure 4A:
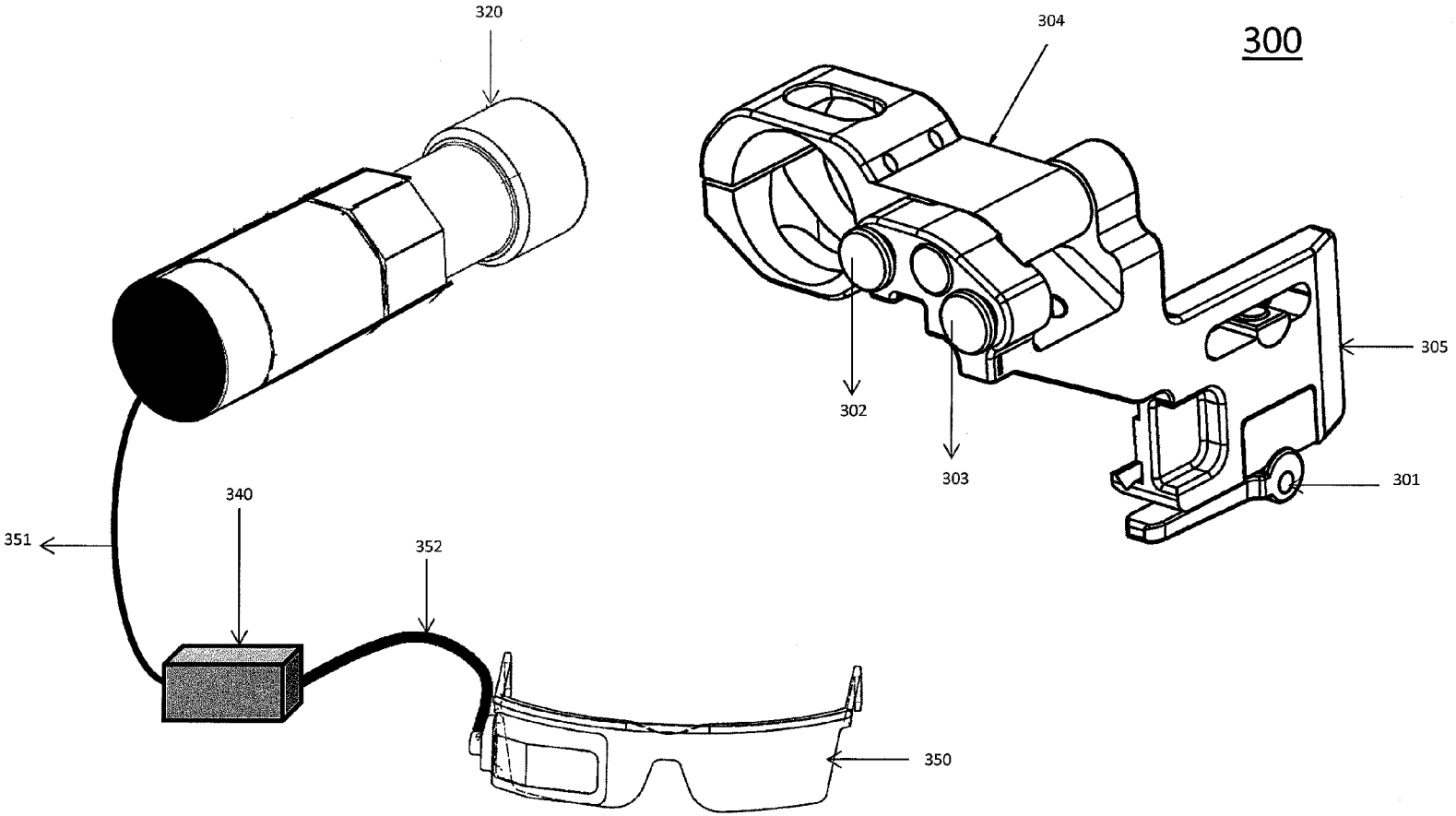
FIG. 4A shows a perspective view of a right side of the 3-5× magnification mount with a camera, control box and display according to an example embodiment of the invention.

FIG. 4A shows in greater detail, the 3-5× magnification mount 300 with a bullet camera 320. Simply by installing a bullet camera 320 inside the optical housing 304, users can convert the UMS 100 into a Digital Machinegun Optic.

Figure 4B:
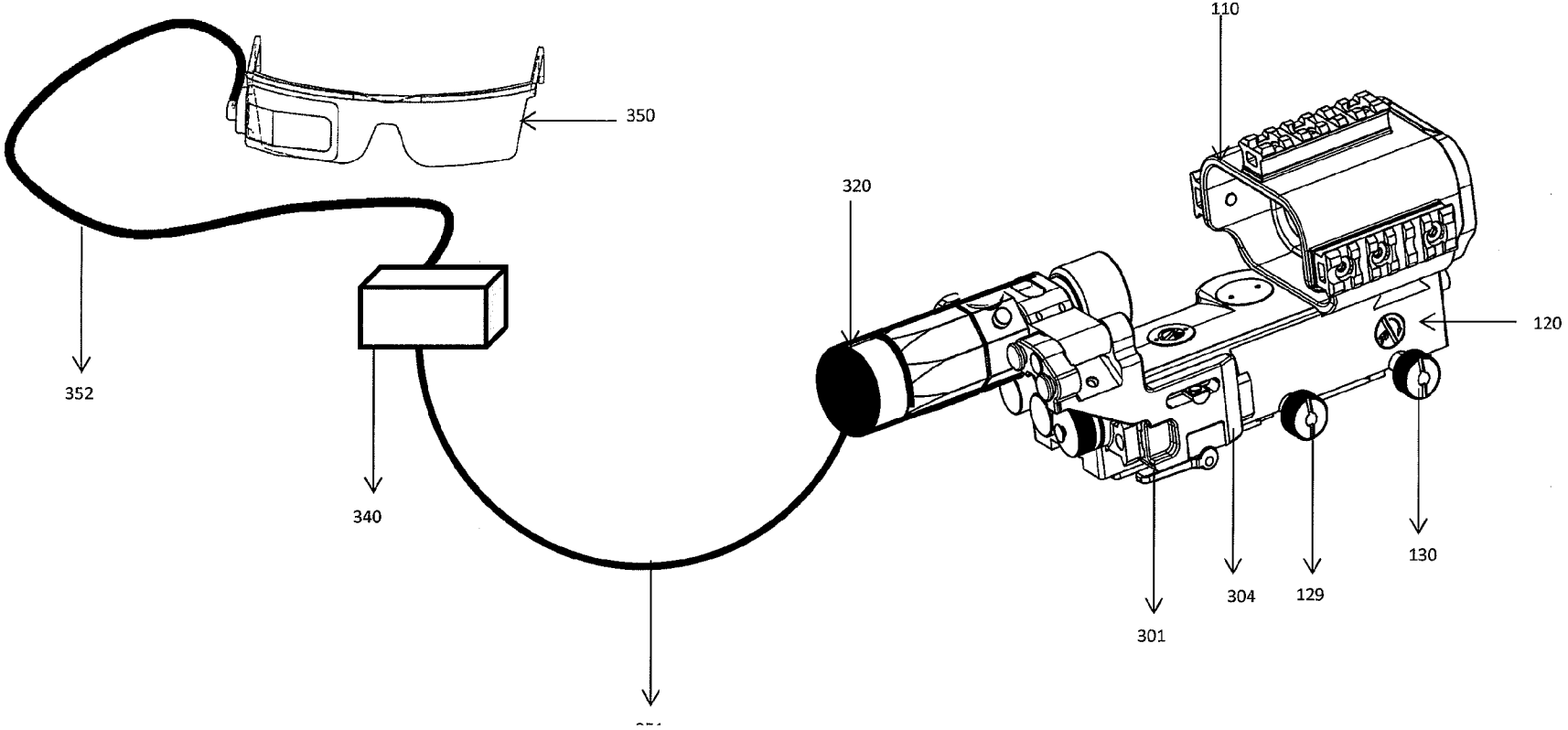
FIG. 4B shows the UMS integrated with a bullet camera attached to the 3-5× magnification mount, a control box and a head mounted display according to an example embodiment of the invention.

FIG. 4B shows in greater detail, the 3-5× magnification mount 300 with a bullet camera 320 installed to the UMS 100. In embodiments of the invention, a bullet camera is connected to a control box that provides required power. For displaying images or target information, a control box 340 is connected to a Head Mounted Display (HMD) 350 or any LCD monitor or PDA via first and second cables 351 and 352. The UMS 100 integrated with the bullet camera 320 offers soldiers options to engage enemy targets without exposing their bodies. Detecting and engaging enemy targets can be accomplished just by looking at a display. This configuration converts any machineguns into corner shot machineguns or a Digital Machinegun Optic.600

Figure 5A:
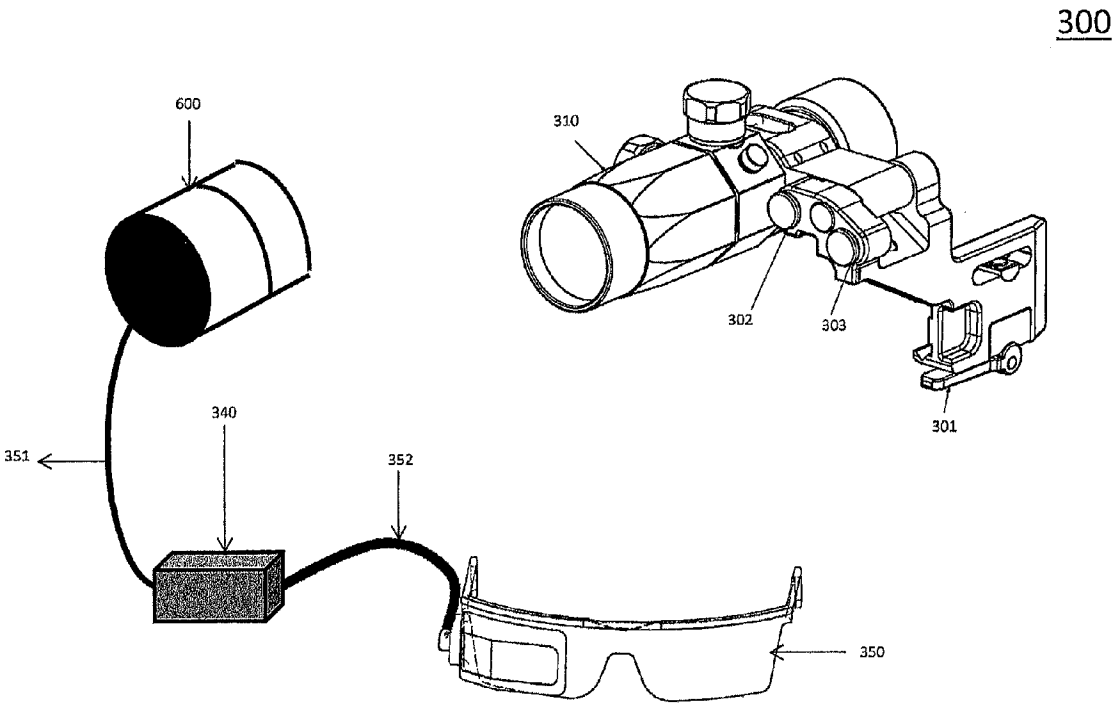
FIG. 5A shows a perspective view of a right side of the 3-5× magnification mount with a magnifier, an EyePiece camera, a control box and a display according to an example embodiment of the invention.

FIG. 5A shows in greater detail, an EyePiece Camera 600 and the 3-5× magnification mount 300 with the 3× magnifier 310. Simply by installing the EyePiece camera 600 behind the 3× magnifier, users can convert the UMS 100 into a Digital Machinegun Optic.

Figure 5B:
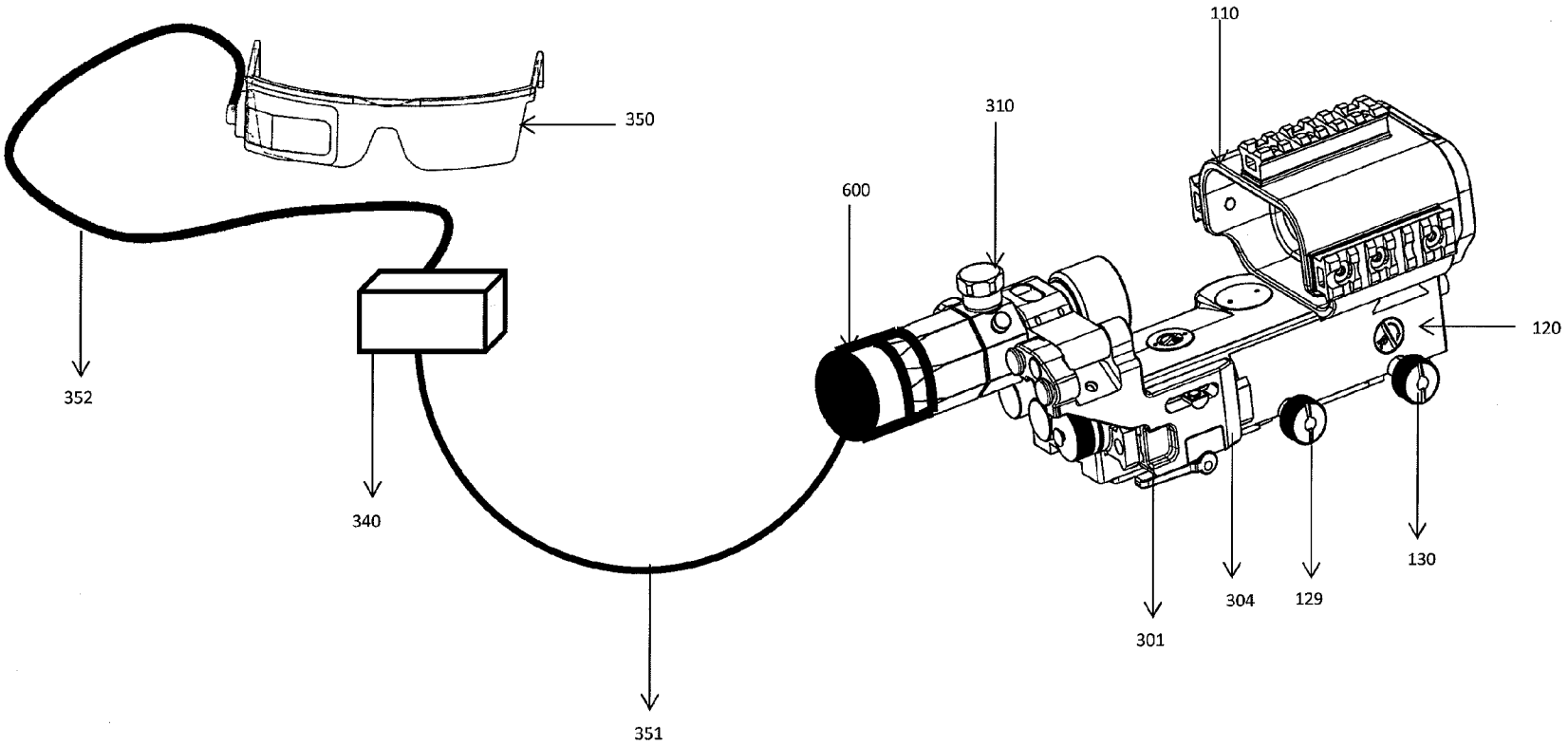
FIG. 5B shows the UMS integrated with an EyePiece camera attached behind the 3× magnifier, a control box and a head mounted display according to an example embodiment of the invention.

FIG. 5B shows in greater detail, the 3-5× magnification mount 300 with the EyePiece camera 600 attached behind the 3× magnifier 310 installed to the UMS 100. In an embodiment of the invention, an EyePiece camera is connected to a control box that provides required power. For displaying images or target information, a control box 340 is connected to a Head Mounted Display (HMD) 350 or any LCD monitor or PDA. The UMS 100 integrated with the EyePiece camera offers soldiers options to engage enemy targets without exposing their bodies. Detecting and engaging enemy targets can be accomplished just by looking at a display. This configuration converts any machineguns into corner shot machineguns or a Digital Machinegun Optic.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed here is:

1. A Universal Machinegun Sight (UMS) with a modular design, the UMS comprising:

a main body receiving a lens body in a detachable manner;

a mounting solution disposed in the main body;

a wheel type bullet drop compensation device to accept various caliber disks and disposed in the main body;

a removable LED module disposed on the main body; and a magnification mounting rail disposed on the main body, wherein the various caliber disks are mounted horizontally within the main body, and have an axis of rotation that is vertically aligned with the main body.

2. The UMS of claim 1, wherein the mounting solution comprises a plurality of locking bolts configured to attach the UMS to various machineguns without use of tools.

3. The UMS of claim 1, wherein the various caliber disks include at least one of a 5.56 mm disk, a 7.62 mm disk, a 12.7 mm disk, a dual disk (7.62 mm/12 .7 mm), and a 20 mm disk.

4. The UMS of claim 3, wherein the UMS is configured to allow only one caliber disk to be installed at a time and allows a user to quickly replace a disk to enable use of the UMS with various machineguns.

5. The UMS of claim 1, wherein the lens body includes:

a transparent sight lens;

an outer lens retention frame; and an inner lens retention frame, wherein the outer and inner retention frames install the sight lens inside the lens body by at least one focus angle, and protect the transparent sight lens from shocks and vibrations.

6. The UMS of claim 5, wherein the outer lens retention frame and the inner lens retention frame are adjustable to install the transparent sight lens at a desired focal angle for a reticle.

7. The UMS of claim 5, wherein the outer lens retention frame and the inner lens retention frame secure the transparent sight lens to the lens body.

8. The UMS of claim 1, wherein the main body is configured to accommodate various size lens bodies.

9. The UMS of claim 8, wherein each lens body is configured to be moved back and forth to identify an optical focal distance of a reticle from the removable LED module.

10. The UMS of claim 1, wherein the main body lacks a drainage hole in front of the removable LED Module.

11. The UMS of claim 1, further comprising a magnification mount, wherein the magnification mount is attached to the main body using the magnification mounting rail.

12. The UMS of claim 11, wherein the magnification mount is configured to attach at least one of magnifiers, cameras and optical devices to the main body.

13. The UMS of claim 12, wherein the removable LED module includes at least one removable etched lens having range finder markings.

14. The UMS of claim 13, wherein the range finder markings are at least one of a dot, a circle, and a hash mark.

15. The UMS of claim 1, wherein the various caliber disks of the UMS enable use of one machinegun sight for various size machineguns by selecting and installing the various caliber disks.

16. The UMS of claim 1, wherein the lens body is removable from the main body so that another lens body is attachable to the main body.

17. The UMS of claim 1, wherein each disk has a plurality of radially extending extensions, an intermediate ring portion, and an aperture in the middle of the intermediate ring portion, and wherein the aperture has a smooth upper wall portion and a toothed lower wall portion.

* * * * *